US006581431B2

(12) United States Patent
Vrubl et al.

(10) Patent No.: US 6,581,431 B2
(45) Date of Patent: Jun. 24, 2003

(54) ECCENTRIC PIPE SECTIONS

(75) Inventors: Radek Vrubl, Usti nad Labem (CZ); Roland Gloor, Frick (CH)

(73) Assignee: Alcan Technology & Management Ltd., Neuhausen am Rheinfall (CH)

( * ) Notice: Subject to any disclaimer, the term of this patent is extended or adjusted under 35 U.S.C. 154(b) by 0 days.

(21) Appl. No.: 09/925,924

(22) Filed: Aug. 9, 2001

(65) Prior Publication Data

US 2002/0038564 A1 Apr. 4, 2002

(30) Foreign Application Priority Data

Aug. 9, 2000 (EP) ..... 00810711

(51) Int. Cl.[7] ..... B21C 23/04
(52) U.S. Cl. ..... 72/264; 72/260; 72/265
(58) Field of Search ..... 72/253.1, 257, 72/260, 263, 264, 265, 266, 269, 272, 273, 273.5

(56) References Cited

U.S. PATENT DOCUMENTS

| | | | | |
|---|---|---|---|---|
| 1,916,645 A | | 7/1933 | Taylor | |
| 4,137,745 A | * | 2/1979 | Murafou et al. | 72/263 |
| 5,305,626 A | * | 4/1994 | Tiekink | 72/257 |
| 6,470,726 B1 | * | 10/2002 | Murata et al. | 72/260 |

FOREIGN PATENT DOCUMENTS

| | | | | |
|---|---|---|---|---|
| GB | 2 169 231 | | 9/1986 | |
| JP | 62-263823 | * | 11/1987 | 72/264 |
| JP | 5-154539 | * | 6/1993 | 72/264 |
| SU | 627883 | * | 10/1978 | 72/264 |

* cited by examiner

*Primary Examiner*—Ed Tolan
(74) *Attorney, Agent, or Firm*—Ostrolenk, Faber, Gerb & Soffen, LLP

(57) ABSTRACT

An extrusion tool for an extrusion press for manufacturing seamless, eccentric pipe sections—in particular pipe sections with circular outer and inner contours—from extrusion blocks, in particular from extrusion billets. The extrusion tool contains a container with a chamber with a longitudinal axis $M_R$ which accommodates the extrusion block, an extrusion stem which is introduced into the container chamber, and features a dummy block, a mandrel arm with a longitudinal axis $M_D$ forming the inner wall of the pipe-section, and a die with an opening with a longitudinal axis $M_M$ forming the outer wall of the pipe section. The mandrel arm is arranged such that it can be pushed out of the dummy block through the extrusion block up to or into the die opening. The mandrel arm in the position for extrusion is arranged eccentric in cross-section with respect to the container chamber and the die opening and the die opening is arranged eccentric in cross-section with respect to the container chamber.

19 Claims, 2 Drawing Sheets

ECCENTRIC PIPE SECTIONS

BACKGROUND OF THE INVENTION

The present invention relates to an extrusion press device for manufacturing eccentric pipe sections—in particular pipe sections with circular outer and inner contours—from extrusion blocks, in particular extrusion billets. The extrusion device features a container with a chamber with longitudinal axis $M_R$ which accommodates the extrusion block, an extrusion stem which is introduced into the container chamber, and features a dummy block, a mandrel body forming the inner wall of the pipe-section, and a die with an opening with longitudinal axis $M_M$ forming the outer wall of the pipe section. The invention further relates a process for manufacturing seamless, eccentric pipe sections, and the use thereof.

Pipe sections produced by means of extrusion processes are characterised by way of an outer and inner wall or an outer and inner contour of round cross-section. The outer and inner contours usually exhibit the same shape as viewed in cross-section.

The production of concentric pipe sections with a wall thickness which is essentially uniform, by means of extrusion, is known. Also known are extrusion processes which permit seamless concentric pipe sections to be produced. The expression "concentric" indicates that the geometric middle points of the outer and inner contours as viewed in cross-section coincide with each other, with the result that when the outer and inner contours are of the same shape, the wall thickness over the whole cross-section is constant.

The production of seamless, concentric pipe sections is based on the principle of so-called extrusion over a mandrel. A mandrel body with mandrel arm and mandrel tip is advanced from a stem body, in the form of a hollow stem, into the container chamber and penetrates completely the extrusion block introduced into the container chamber. The mandrel tip is advanced up to or into the die opening immediately following the container chamber. The mandrel body does not have any points anchoring it to the die with the result that the extrusion block material is able to flow over the whole of the outer contour of the mandrel and into the die opening without forming a seam. In this process, because of the high flow stresses, the mandrel body cannot always be held exactly in the central position, the resultant pipe section is often not exactly concentric, as is desired, but instead slightly eccentric.

"Eccentric" means that the geometric middle points of the outer and inner contours—as viewed in cross-section—do not coincide, but instead lie a distance apart from each other and, accordingly, the thickness of the section wall varies over the cross-section.

The eccentricity of seamless, extruded pipe sections that are intended to be concentric is however very small, amounting to 0–10% of the average cross-sectional wall thickness of the section.

The eccentricity corresponds according its definition to the direct distance d between the two geometric centres of the outer and inner contour of the pipe section in cross-section.

For certain applications on the other hand use is made of pipe sections which are purposefully eccentric in cross-section. The eccentricity of such pipe sections is however, generally much greater than the process-related eccentricity values achieved with concentric designed pipe sections.

It is known to produce eccentric pipe sections by extrusion methods employing multi-chamber dies. The mandrel body is incorporated as a mandrel part in a die plate. The material to be extruded is fed to a welding chamber via a plurality of inlets under arms of the mandrel and, forming weld seams, passes around a shape-forming mandrel and through the die opening. Pipe sections manufactured by this process contain so called extrusion weld seams. This process is, however, suitable only for easily extrudable alloys exhibiting low mechanical strength values.

If the outer and inner contours have the same geometric shape, in particular that of a circle, then the eccentricity can be expressed by the following equation:

$$E = \frac{S_{\max} - S_{\min}}{2} \tag{1}$$

where $S_{max}$ represents the maximum and $S_{min}$ the minimum thickness of the wall of the pipe section. The average wall thickness $S_{av}$ of the eccentric pipe section in question can be calculated as follows:

$$S_{av} = \frac{S_{\max} + S_{\min}}{2} \tag{2}$$

The magnitude of $S_{av}$ also corresponds to the wall thickness of a concentric pipe section with the same outer and inner contour measurements as the eccentric pipe section.

To compare the eccentricities of pipe sections of various sizes, i.e. such sections with different outer and inner contour measurements, the so called relative eccentricity $E_R$ is calculated as follows:

$$E_R = E/S_{av} \tag{3}$$

Whereas the continuous manufacture of seamless extruded concentric pipe sections is practised on an industrial scale, the production of seamless, eccentric pipe sections with constant eccentricity along the length—allowing for a tolerance range—has not yet been solved satisfactorily.

Trials aimed at the production of seamless, intentionally eccentric pipe sections by extrusion over a mandrel, result in the mandrel arm usually being deflected towards the middle of the die opening as a result of the different flow pressures over the cross-section. This results in pipe sections with eccentricity values that deviate significantly from the intended values and non-uniformly along the length of the section; these eccentricities lie far beyond the normal inaccuracy of 0 to 10% of the average wall thickness. The deflection of the mandrel arm towards the centre of the die opening can, furthermore, lead to parts of the extrusion press device being damaged. Also, eccentric pipe sections manufactured this way tend to bend and curve when they emerge from the die. This means that the final length of pipe section bends off to one side on leaving the die.

SUMMARY OF THE INVENTION

The object of the present invention is to propose an extrusion press device and an extrusion process for manufacturing seamless, eccentric pipe sections having as constant as possible eccentricity along their length.

That objective is achieved by way of the invention in that the mandrel body, when in the position for extrusion, is a mandrel arm of longitudinal axis $M_D$ with a mandrel tip that can be pushed out of the dummy block through the extrusion block up to or into the die opening, such that the material of the extrusion block can flow in a seamless manner around the mandrel arm, through the die opening. The mandrel arm is arranged eccentric in cross-section with respect to the container chamber and with respect to the die opening, and the die opening is arranged eccentric in cross-section with respect to the container chamber. The longitudinal axis $M_D$ of the mandrel arm and the longitudinal axis $M_R$ of the container are a distance apart and lie essentially parallel to the longitudinal axis $M_K$ of the die opening, in such a way that the longitudinal axis $M_K$ of the die opening in cross-section lies between a pair of straight lines $g_1$ and $g_2$ each passing through the mandrel arm longitudinal axis $M_D$ and the container chamber longitudinal axis $M_R$ of as well as perpendicular to lines p connecting the mandrel arm longitudinal axis $M_D$ and the container chamber longitudinal axis $M_R$.

The container chamber longitudinal axis $M_R$, the mandrel arm longitudinal axis $M_D$ and the die opening longitudinal axis $M_K$ are so called middle axes which in cross-section pass through the geometric middle point of the elements of the device.

The mandrel arm longitudinal axis $M_D$, the container chamber longitudinal axis $M_R$ and the die opening longitudinal axis $M_K$ are preferably parallel to each other.

In a preferred version the eccentric arrangement of the mandrel arm with respect to the container chamber and the die opening, and the arrangement of the die opening with respect to the container chamber are chosen such that the container chamber longitudinal axis $M_R$, the mandrel arm longitudinal axis $M_D$ and the die opening longitudinal axis $M_K$ lie on a common plane and parallel to each other, and the die opening longitudinal axis $M_K$ lies in cross-section between the container chamber longitudinal axis $M_R$ and the mandrel arm longitudinal axis $M_D$. That is, the die opening longitudinal axis $M_K$ lies, as viewed in cross-section, on straight lines p connecting the chamber longitudinal axis $M_R$ and the mandrel arm longitudinal axis $M_D$.

In a particularly preferred version the relative eccentricity $E_{Rr}$ of the hollow cylinder shaped, bored extrusion block corresponds to the relative eccentricity $E_{Rm}$ of the pipe section or extrusion.

The die axis $M_M$ itself also preferably lies concentric with the container chamber axis $M_R$, i.e. the die opening lies eccentric with respect to the outer contour of the die.

The die i.e. the die opening is with respect to the container, i.e. the container chamber, preferably fixed and unmoveable.

The extrusion block is preferably a circular cylindrical-shaped billet. The container chamber is likewise circular cylindrical-shaped.

The device according to the invention is particularly suitable for manufacturing pipe sections of circular outer and inner contours, whereby the shaping wall of the mandrel arm and the shaping wall of the die opening are circular in cross-section.

The extrusion press device according to the invention is particularly suitable for extruding extrusion blocks made of metallic materials, especially such as aluminum or aluminum alloys, such as aluminum wrought alloys.

In the extrusion press device according to the invention, the mandrel arm which forms the inner contour of the pipe section during extrusion is not part of the extrusion die and therefore is not anchored to the die, but instead is provided as a hollow stem on the stem body and, prior to the actual extrusion process, is moved out of the dummy block of the stem body up to the extrusion block in the container chamber whereby the mandrel arm penetrates completely the extrusion block in the container chamber in the direction of extrusion.

The mandrel arm may be of the kind that moves in the extrusion direction during the extrusion process or it may be fixed in place. The extrusion process may also be indirect extrusion or, preferably, a direct extrusion process. Usefully, the mandrel arm also features a mandrel tip which engages with or enters into the die, said tip having a slightly smaller diameter than the rear part of the mandrel. The diameter $d_t$ of the mandrel tip is less than 10%, in particular less than 5%, smaller than the diameter $D_T$ of the rear part of the mandrel arm.

The mandrel tip of the mandrel arm is moved up to or into the die opening. In the direct extrusion process the stem body is then advanced and the extrusion block material pressed through the die. The extrusion block material is thereby pressed around the mandrel arm and flows in the direction of extrusion ring-like along the mandrel arm and through the die opening without forming a seam. The mandrel tip situated in the die region produces the final shape of the inner wall of the pipe section being produced, whereas the die opening produces the final shape of the outer wall of the pipe section. The extrusion block shaped in the die emerges from the die as a seamless, eccentric pipe section. By means of the eccentric arrangement of the mandrel, container chamber and die opening according to the invention, one obtains a uniform distribution of the extrusion or flow pressure around the mandrel arm which lies free in the container chamber, with the result that it is not displaced from its original position during extrusion. Furthermore, because of the extrusion press device according to the invention, the rates of flow of the extrusion block material i.e. extrudate within the die opening is uniform, with the result that the emerging pipe section does not bend to the side.

In the following, with the aid of a preferred embodiment of the inventive device, the technical operation of the invention is explained. The container chamber longitudinal axis $M_R$, the mandrel arm longitudinal axis $M_D$ and the die opening longitudinal axis $M_K$ lie in a common plane and parallel to each other, whereby the die opening longitudinal axis $M_K$ lies in cross-section between the container chamber longitudinal axis $M_R$ and the mandrel arm longitudinal axis $M_D$.

The descriptions refer to the production of pipe sections having circular inner and outer contours using a cylindrical shaped extrudate in a container chamber of the same shape.

As described above, the flow rates in the container chamber and in the die opening and the pressure or flow forces acting on the mandrel body must be constant over the relevant cross-section, in order to be able to extrude seamless, concentric or eccentric pipe sections.

These process parameters may, according to the invention, be controlled by varying the width of cross-sectional flow in the container chamber.

During extrusion, the stem and with that the extrudate in the container chamber moves in the direction of extrusion at a rate of $v_1$. In the through-flow cross-section in the container chamber exhibiting the smallest radial distance A between the mandrel arm and the container wall, i.e. in the region with the smallest through-flow cross-section, the through-flow of extrudate amounts to $A*v_1$. In the through-flow cross-section in the container chamber exhibiting the largest radial distance B between the mandrel arm and the container wall, i.e. in the region with the largest through-flow cross-section, the extrudate flow amounts to $B*v_1$.

In order to prevent the extrusion from bending to the side when it leaves the die, the extrudate must move with a uniform flow rate $v_2$ across its cross-section. The flow of extrudate material in the through-flow cross-section with the smallest radial distance a, which lies along the line of the through-flow cross-section A, amounts, therefore, between the mandrel arm and the die opening wall to $a*v_2$. The through-flow in the through-flow cross-section with the largest radial distance b, which lies along the line of the through-flow cross-section B, amounts, therefore, between the mandrel arm and the die opening wall to $b*v_2$.

As the extrudate material cannot be compressed, and there should be no flow of material around the mandrel arm in the container transverse to the direction of extrusion, the through-flow $A*v_2$ of extrudate at the smallest width of through-flow cross-section in the container should correspond to the through-flow $a*v_2$ of the extrudate at the smallest width of through-flow cross-section in the die opening, and the through-flow $B*v_1$ of the extrudate at the largest width of through-flow cross-section in the container corresponds to the through-flow $b*v_2$ of extrudate at the largest width of through-flow cross-section in the die opening.

As a result the following set of equations is obtained:

$$A\times v_1=a\times v_2 \quad (4)$$

$$B\times v_1=b\times v_2 \quad (5)$$

From this the following relationship can be derived:

$$A/B=a/b \quad (6)$$

The ratio A/B of the smallest radial distance A to the largest radial distance B between the mandrel surface and the container chamber wall corresponds therefore to the ratio a/b of the smallest radial distance a to the largest radial distance b between the mandrel arm surface and the die opening wall.

The equation (6) expresses, amongst other things, the condition that the relative eccentricity $E_{Rr}$ of the hollow cylindrical shaped, bored extrudate block should correspond to the relative eccentricity $E_{Rm}$ of the pipe section or extrusion. The "wall thickness" according to equations (1) and (2) for calculating the relative eccentricity $E_{Rm}$ correspond here to the radial distances between the surface of the mandrel arm and the wall of the container chamber or the wall of the die opening.

On the basis of the above, the relative eccentricity $E_{Rr}$ of the mandrel body with respect to the container chamber usefully deviates by less than 10%, advantageously less than 5%, in particular less than 2%, from the relative eccentricity $E_{Rm}$ of the mandrel arm with respect to the die.

The more accurately the conditions formulated in equation (6) are observed, the less the mandrel arm is displaced towards the die opening longitudinal axis, and the smaller is the deviation of the effective eccentricity of the pipe section produced compared to its intended values. Further, by observing the above conditions, the eccentricity of the pipe section remains constant over the length of the pipe section.

Also in the case of pipe sections designed with eccentricity it is necessary to reckon with small fluctuations in eccentricity along the section length. These fluctuations in eccentricity amount to—as with seamless concentric pipes—at most 0 to 10% of the average wall thickness $S_{av}$ of the pipe-section, and is sufficient to meet the requirements regarding tolerances for seamless, eccentric pipe sections.

The device according to the invention is suitable also for manufacturing pipe sections of e.g. an elliptical, oval or some other shape, in particular roundish, or polygonal cross-section. The device may also be employed for producing pipe sections with different geometrical outer and inner contours as viewed in cross-section. Observing the previously mentioned condition viz., $$A/B=a/b$$

as accurately as possible is also in such cases decisive for successful production i.e. for a good quality of final product.

Also within the scope of the invention is an extrusion process for manufacturing seamless, eccentric pipe sections from extrusion blocks, in particular extrusion billets, using the extrusion press device discussed above.

The extrusion process according to the invention is characterised in that the extrusion block is pushed to the die end face by means of an extrusion stem and the mandrel arm is driven from the dummy block into the extrusion block and pushed by the mandrel tip in a position eccentric with respect to the die opening up to or into the die opening, whereby the mandrel arm is pushed through the extrusion block in an eccentric position and the extrusion block is pushed through the die by the extrusion stem, in such a manner that the extrusion block material flows without forming a seam over the whole cross-section at uniform speed around the mandrel tip into the die opening.

The mandrel arm is preferably moved in an eccentric position with a relative eccentricity $E_{Rr}$ to the container chamber and in an eccentric position with a relative eccentricity $E_{Rm}$ to the die opening and the relative eccentricity $E_{Rr}$ corresponds essentially, preferably exactly, to the relative eccentricity $E_{Rm}$. The longitudinal axis $M_K$ of the die opening, the mandrel longitudinal axis $M_D$ and the container chamber longitudinal axis $M_R$ in cross-section usefully lie on the same plane.

The process is suitable in particular for extruding metallic materials, in particular aluminium or aluminium alloys such as aluminium wrought alloys.

Seamless eccentric pipe sections manufactured using the process according to the invention can e.g. be employed as, or processed further into, support sections which are subjected to directional, in particular one dimensional, loads. The region with maximum wall thickness is situated in the zone where the largest extension forces are present due to bending. Eccentric pipes designed to bear bending forces are, for the same load bearing capacity, much lighter than concentric pipes. Furthermore, eccentric pipe sections are particularly suitable for manufacturing bent pipe-sections e.g. elbow-joint lengths. To that end, the eccentric pipe section is bent in such a manner that the thick-walled part of the pipe is situated in the zone undergoing elongation and the thin-walled part of the pipe is situated in the compression zone. In the elongated region therefore, there is excess material available, which is necessary for elongation purposes. As a result of the thicker wall section no critical thinning of the pipe wall occurs on the outer side of the pipe section. On the other hand, the wall can be thinner the compression zone as the wall is not stretched there. If concentric pipe sections are employed for this purpose, then the wall thickness must be chosen with regard to the part undergoing the largest forces i.e. the stretched part. This means that in other parts undergoing compression, the wall thickness is over-dimensioned. By using eccentric pipe sections instead of concentric pipe sections, weight can be saved while maintaining the same mechanical properties.

The eccentric shape of the pipe section guarantees a continuous transition from the wall thickening to the wall thinning. Similarly on bending the pipe there is a continuous transition from stretching to compression, whereby in the neutral zone i.e. where there is neither stretching nor compression, the thickness of the pipe section has the average thickness of the eccentric pipe section.

Seamless eccentric pipes are especially suitable for manufacturing U-shaped rear axle supports for private cars. Hydrostatic forming, i.e. shaping with high internal pressure, is particularly suitable for shaping such pipe sections.

The seamless eccentric pipe sections manufactured using the device according to the invention may be shape-formed or bent e.g. using hydrostatic forming or other cold forming processes. Pipe sections conceived with eccentric cross-sections are generally suited to forming processes employing high internal pressure, in which the wall regions are stretched to different degrees. With eccentric pipe sections material can be specifically made available for the stretching regions, while in regions which are subjected to less the wall section can be thinner.

Compared with eccentric pipe sections produced using multi-chamber dies, the seamless eccentric pipe sections do not have any weaknesses such as extrusion welds.

The above mentioned eccentric pipe sections may e.g. exhibit an outer diameter of 10 to 500 cm, in particular 10 to 100 cm, and wall thicknesses of 1 to 50 cm, in particular 1 to 10 cm.

BRIEF DESCRIPTION OF THE DRAWINGS

In the following the invention is explained in greater detail with the aid of drawings attached. These show.

DETAILED DESCRIPTION OF THE PREFERRED EMBODIMENTS

Figure 1A:
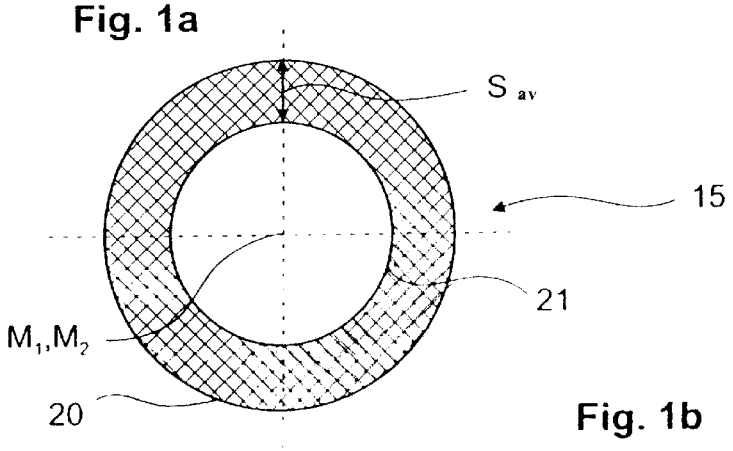
FIG. 1*a*: a cross-section through a circular, concentric pipe section.
Figure 1B:
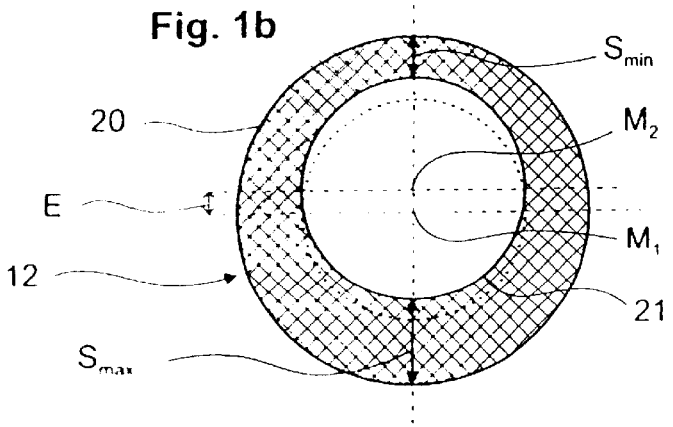
FIG. 1*b*: a cross-section through a circular, eccentric pipe section.

The concentric pipe section 15 shown in FIG. 1*a* exhibits an outer contour 20 and an inner contour 21, both of which are circular in shape in cross-section and are concentric with each other, with the result that the central longitudinal axes $M_1$, $M_2$ of both contours coincide, and the pipe section 15 exhibits a constant average wall thickness $S_{av}$. Shown in FIG. 1*b* is an eccentric pipe section 12 with outer contour 20 and inner contour 21, both circular in cross-section and eccentrically arranged with the result that the central longitudinal axes $M_1$, $M_2$ of both contours lie a distance apart, and the pipe section 12 exhibits a wall thickness that varies between a maximum wall thickness $S_{max}$ and a minimum wall thickness $S_{min}$. The eccentricity E corresponds to the distance between both middle axes $M_1$, $M_2$ of the outer and inner contours. As the outer contour 20 and the inner contour 21 are dimensionally the same as that of the concentric pipe section 15 in FIG. 1*a*, the average wall thickness $S_{av}$ of the eccentric pipe section 12 is equal to that of the concentric pipe section 15.

Figure 2:
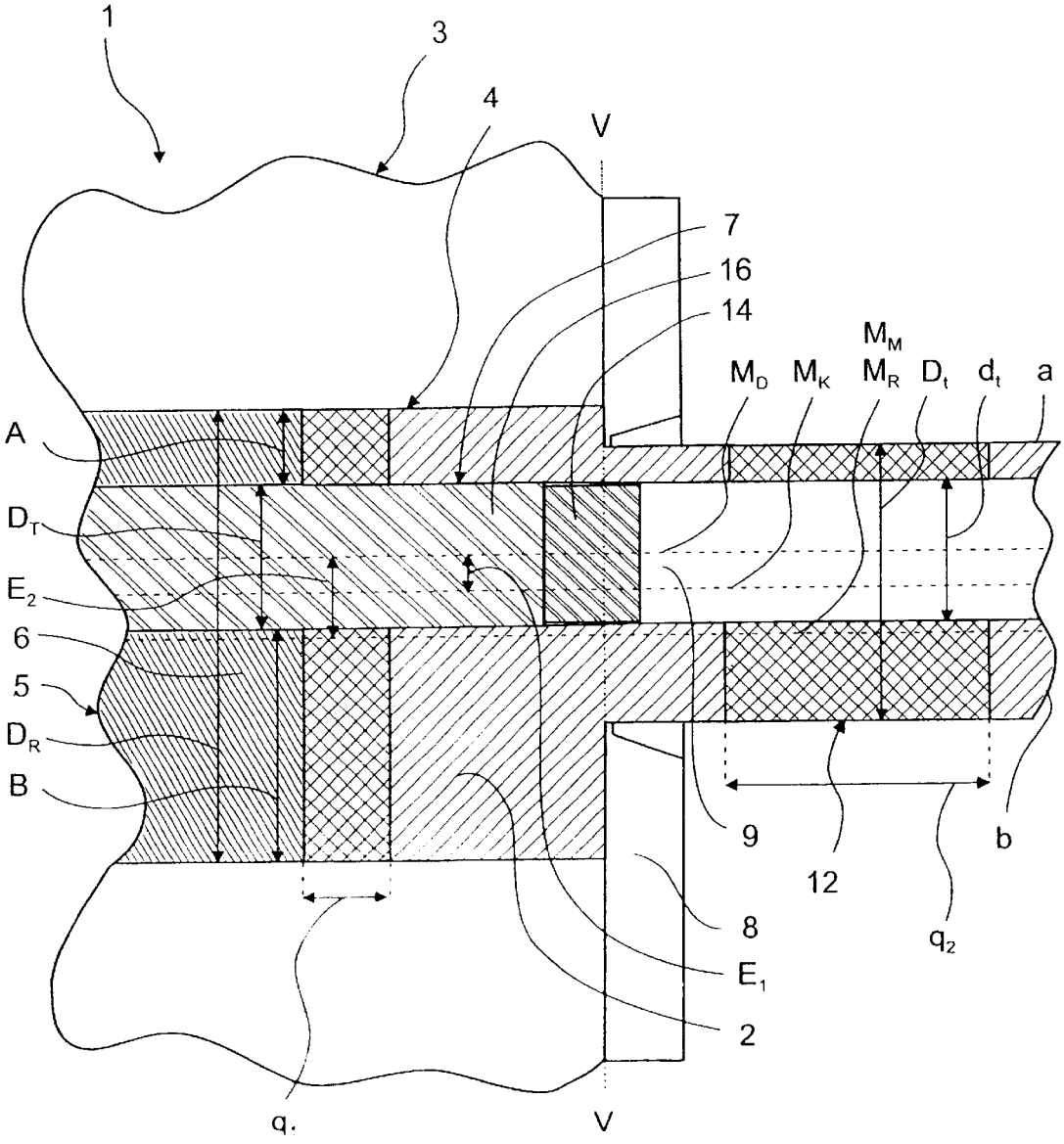
FIG. 2: a schematic longitudinal section through the extrusion took of an extrusion press according to the invention for manufacturing circular, eccentric pipe sections.

The version of extrusion press tool 1 according to the invention shown in FIG. 2 contains a container 3 with container chamber 4 of diameter $D_R$. A circular cylindrical shaped extrusion block 2 is introduced into the container chamber 4 for extrusion. Further, a hollow extrusion stem 5 with an extrusion press dummy block 6 situated on the end pointing in the direction for extrusion and contacting the extrusion block 2. After the container 3 in the direction of extrusion is a die 8 with die opening 9, which is connected to the container-chamber 4 via a passage in the die.

A mandrel body 7 with a mandrel arm 16 and a mandrel tip 14 is mounted in the extrusion stem 5 and, in FIG. 2 shown, is moved out of the dummy block 6 into the container chamber 4, whereby the mandrel arm 16 completely penetrates the extrusion block 2. The tip 14 of the mandrel arm 16 enters the die opening 9. The mandrel arm 16 is of diameter $D_r$ and the mandrel tip 14 of diameter $d_r$, which is slightly smaller than diameter $D_r$.

Figure 3:
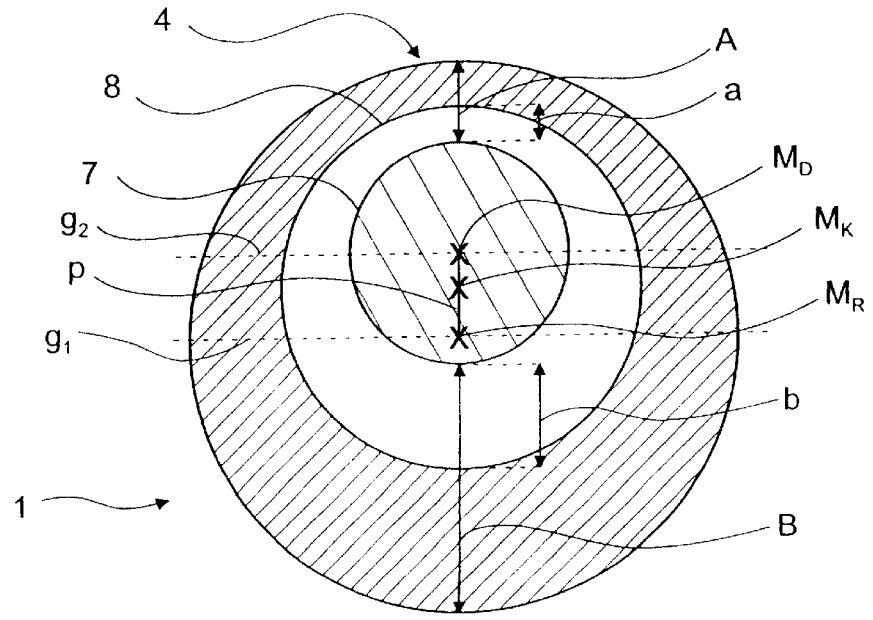
FIG. 3: a schematic cross-section through an extrusion tool according to FIG. 2 along line v—v.

The container chamber 4 exhibits a longitudinal axis $M_R$, the mandrel arm 16 a longitudinal axis $M_D$, the die 8 a longitudinal axis $M_M$ and the die opening a longitudinal axis $M_K$ (see also FIG. 3).

The mandrel arm 16 is arranged eccentric to the container chamber 4 and exhibits therefore with respect to the container chamber 4 a minimum wall distance A and a maximum wall distance B. The mandrel arm is also arranged eccentric to the die opening 9. The mandrel arm 16, or the mandrel tip 14, exhibits therefore with respect to the die opening 9 a minimum wall distance a and a maximum wall distance b.

The die opening longitudinal axis $M_K$ lies—as viewed in cross-section—between two straight lines $g_1$ and $g_2$ running through the die opening longitudinal axis $M_D$ and the container chamber axis $M_R$ and perpendicular to the line p between the mandrel longitudinal axis $M_D$ and the container chamber longitudinal axis $M_R$ (see FIG. 3).

In the present preferred version the eccentric arrangement of the mandrel arm 16 with respect to the container chamber 4 and the die opening 9 is chosen such that the container chamber axis $M_R$, the mandrel arm longitudinal axis $M_D$ and the die opening longitudinal axis $M_K$, in cross-section lie between the container chamber axis $M_R$ and the mandrel longitudinal axis $M_D$ i.e. on the joining line p.

The eccentric arrangement of the mandrel arm 16 with respect to the container chamber 4 and the die opening 9 is especially chosen such that the following condition is met:

$$A/B=a/b.$$

At the start of extrusion the container chamber 4 is charged with a cylindrical-shaped extrusion block 2 which is preferably of slightly smaller diameter than that of the container chamber 4. To begin extrusion, the extrusion stem 5 with its dummy block 6 is advanced up to the end face of the extrusion block 2 and the mandrel arm 16 driven out of the dummy block 6 into the extrusion block 2 until the mandrel tip 14 engages in the die opening 9. The extrusion stem 5 is driven further forward so that the material of the extrusion block 2 flows without forming a seam around the mandrel arm 16 through the die opening 9. Because of the eccentric arrangement of the mandrel arm 16 with respect to the container chamber 4 and the die opening 9, the extrusion block material flows essentially towards the die opening 9 in the direction of extrusion. Practically no tangential flow in cross-section occurs around the mandrel arm 16. The rate of material flow in the die opening 9 is constant over the whole cross-section, with the result that the pipe section does not bend on emerging from the die 8. If for example, in a specific unit of time, the dummy block 6 is advanced a distance $q_1$, in the direction of the die 8, extrusion block material flows into the die opening 9 in an amount corresponding to the space displaced in the container chamber 4, this with uniform cross-sectional force applied to the mandrel arm 16. Because of the eccentric arrangement, according to the invention, of the mandrel arm 16 and the die opening 9 with respect to the container chamber 4, the amount of extrusion block material passing through the die opening 9 corresponds to the amount of extrusion block material displaced along the same length, whereby the distance covered $q_2$ by the shaped pipe section 12 is constant over the whole cross-section.

The seamless extruded pipe section 12 exhibits an outer diameter $D_t$ and an inner diameter $d_t$ which corresponds to the diameter $d_t$ of the mandrel tip 14.

The procedure for designing an extrusion tool 1 according to the invention as in FIG. 3 is explained in greater detail in the following.

The requirement is to extrude an eccentric pipe section of outer diameter $D_t$ with circular outer and inner contours, with inner diameter $d_t$ and a minimum wall thickness a and maximum wall thickness b. To that end the average wall thickness $S_{m,\ pipe}$ is calculated using the equation:

$$S_{m,\ pipe}=(Dt-dt)/2=(a+b)/2$$

Further, the eccentricity of the pipe section $E_{pipe}$ is calculated from the equation:

$$E_{pipe}=(b-a)/2=E_1.$$

The amount to which $E_1$ of the die opening longitudinal axis $M_K$ has to be displaced towards the mandrel longitudinal axis $M_D$ corresponds to the eccentricity $E_{pipe}$ of the pipe section 12. The relative eccentricity $E_{R,pipe}$ can then be obtained from the equation:

$$E_{R,pipe}=E_{pipe}/S_{m,\ pipe}.$$

The relative eccentricity $E_{R,Pk}$ of the extrusion block 2 with respect to the mandrel arm 16 should, as explained above, correspond to the relative eccentricity $E_{R,pipe}$ Of the pipe section 12.

The extrusion block 2 of diameter $D_r$ introduced into the container chamber 4 and penetrated by the mandrel arm 16 of shaft diameter $D_t$ has therefore an average wall thickness $S_{m,Pk}$ of $$S_{m,Pk}=(D_R-D_T)/2$$

The eccentricity $E_{Pk}$ of extrusion block 2 according to equation $E_{Pk}=E_{R,pipe}*S_{m,Pk}$ corresponds to the displacement $E_2$ of the mandrel longitudinal axis $M_D$ towards the container axis $M_R$ is consequently $E_2-E_1$.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. An extrusion press device for manufacturing an eccentric pipe section from an extrusion block, said extrusion device comprising: a container with a chamber with a longitudinal axis $M_R$ which accommodates the extrusion block; an extrusion stem which is introduced into the container chamber and features a dummy block; a mandrel body forming an inner wall of the pipe-section; and a die with an opening with a longitudinal axis $M_K$ forming an outer wall of the pipe section, the mandrel body, when in a position for extrusion, is a mandrel arm of longitudinal axis $M_D$ with a tip that can be pushed out of the dummy block through the extrusion block one of up to and into an opening of the die, such that the extrusion block material can flow in a seamless manner around the mandrel arm through the die opening, the mandrel arm being arranged eccentric in cross-section with respect to the container chamber and with respect to the die opening, the die opening being eccentric in cross-section with respect to the container chamber, and the longitudinal axis $M_D$ of the mandrel arm and the longitudinal axis $M_R$ of the container being a distance apart and substantially parallel to the longitudinal axis $M_K$ of the die opening, so that the longitudinal axis $M_K$ of the die opening in cross-section lies between a pair of straight lines $g_1$ and $g_2$ respectively passing through the mandrel arm longitudinal axis $M_D$ and the container chamber longitudinal axis $M_R$ as well as perpendicular to a line p connecting the mandrel arm longitudinal axis $M_D$ and the container chamber longitudinal axis $M_R$.

2. An extrusion press device according to claim 1, wherein the container chamber longitudinal axis $M_R$, the mandrel arm longitudinal axis $M_D$ and the die opening longitudinal axis $M_K$ lie on a common plane and are parallel to each other, and the die opening longitudinal axis $M_K$ lies in cross-section between the container chamber longitudinal axis $M_R$ and the mandrel arm longitudinal axis $M_D$.

3. An extrusion press device according to claim 1, wherein a relative eccentricity $E_R$ of the mandrel arm deviates, with respect to the container chamber, by less than 10% from a relative eccentricity $E_{Rm}$ of the mandrel arm, with respect to the die opening, whereby wall thicknesses for calculating the relative eccentricities are distances between an outer face of the mandrel arm and the container chamber wall and between the outer face of the mandrel arm and a wall of the die opening.

4. An extrusion press device according to claim 3, wherein the relative eccentricity $E_R$ of the mandrel arm deviates by less than 5%.

5. An extrusion press device according to claim 4, wherein the relative eccentricity $E_R$ of the mandrel arm deviates less than 2%.

6. An extrusion press device according to claim 1, wherein the relative eccentricity $E_{Rm}$ is of the tip of the mandrel arm with respect to the die opening.

7. An extrusion press device according to claim 3, wherein a ratio A/B of a smallest radial distance A to a largest radial distance B between the outer face of the mandrel arm and the wall of the container chamber is substantially equal to a ratio a/b of a smallest radial distance a to a largest radial distance b between the outer face of the mandrel arm and the wall of the die opening.

8. An extrusion press device according to claim 7, wherein the ratio A/B is exactly equal to the ratio a/b.

9. An extrusion press device according to claim 7, wherein the ratio a/b is a ratio of the smallest radial distance a to the largest radial distance b between the outer face of the mandrel arm tip and the wall of the die opening.

10. Extrusion press device according to claim 1, wherein the mandrel arm and the die opening have shaping walls that are circular in cross-section.

11. An extrusion press device according to claim 1, wherein the mandrel arm has a diameter $D_T$ and the tip has a diameter $d_t$, where the diameter $d_t$, is less than 10% smaller than the diameter $D_T$, the mandrel arm in the position for extrusion being arranged such that the tip engages in the die opening.

12. An extrusion press device according to claim 11, wherein the diameter $d_t$ is less than 5% smaller than the diameter $D_T$.

13. An extrusion process for manufacturing an eccentric pipe section out of an extrusion block employing an extrusion press device having a container with a chamber with a longitudinal axis $M_R$ which accommodates the extrusion block, an extrusion stem which is introduced into the container chamber and features a dummy block, a mandrel body forming an inner wall of the pipe-section, and a die with an opening with a longitudinal axis $M_K$ forming an outer wall of the pipe section, the mandrel body is a mandrel arm of longitudinal axis $M_D$ with a tip, the mandrel arm being arranged eccentric in cross-section with respect to the container chamber and with respect to the die opening, the die opening being eccentric in cross-section with respect to the container chamber, and the longitudinal axis $M_D$ of the mandrel arm and the longitudinal axis $M_R$ of the container being a distance apart and substantially parallel to the longitudinal axis $M_K$ of the die opening, so that the longitudinal axis $M_K$ of the die opening in cross-section lies between a pair of straight lines $g_1$ and $g_2$ respectively passing through the mandrel arm longitudinal axis $M_D$ and the container chamber longitudinal axis $M_R$ as well as perpendicular to a line p connecting the mandrel arm longitudinal axis $M_D$ and the container chamber longitudinal axis $M_R$, the process comprising the steps of: pushing the extrusion block to the die end face by means of the extrusion stem; driving the mandrel arm from the dummy block into the extrusion block; and pushing the mandrel tip in a position eccentric with respect to the die opening up to or into the die opening, the mandrel arm being pushed through the extrusion block in an eccentric position, and the extrusion block being pushed through the die by the extrusion stem so that extrusion block material flows without forming a seam over the whole cross-section at uniform speed around the mandrel tip into the die, opening.

14. An extrusion process according to claim 13, including moving the mandrel arm into an eccentric position with a relative eccentricity $E_{Rr}$ to the container chamber and in an eccentric position with a relative eccentricity $E_{Rm}$ to the die opening, the relative eccentricity $E_{Rr}$ corresponding substantially to the relative eccentricity $E_{Rm}$, the die opening longitudinal axis $M_K$, the mandrel longitudinal axis $M_D$ and the container chamber axis $M_R$ in cross-section lying on a common plane.

15. An extrusion process according to claim 14, wherein the relative eccentricity $E_{Rr}$ corresponds exactly to the relative eccentricity $E_{Rm}$.

16. A process for producing a bent hollow section out of an extrusion block employing an extrusion press device according having a container with a chamber with a longitudinal axis $M_R$ which accommodates the extrusion block, an extrusion stem which is introduced into the container chamber and features a dummy block, a mandrel body forming an inner wall of the pipe-section, and a die with an opening with a longitudinal axis $M_K$ forming an outer wall of the pipe section, the mandrel body is a mandrel arm of longitudinal axis $M_D$ with a tip, the mandrel arm being arranged eccentric in cross-section with respect to the container chamber and with respect to the die opening, the die opening being eccentric in cross-section with respect to the container chamber, and the longitudinal axis $M_D$ of the mandrel arm and the longitudinal axis $M_R$ of the container being a distance apart and substantially parallel to the longitudinal axis $M_K$ of the die opening so that the longitudinal axis $M_K$ of the die opening in cross-section lies between a pair of straight lines $g_1$ and $g_2$ respectively passing through the mandrel arm longitudinal axis $M_D$ and the container chamber longitudinal axis $M_R$ as well as perpendicular to a line p connecting the mandrel arm longitudinal axis $M_D$ and the container chamber longitudinal axis $M_R$, the process comprising the steps of: pushing the extrusion block to the die end face by means of the extrusion stem; driving the mandrel arm from the dummy block into the extrusion block; and pushing the mandrel tip in a position eccentric with respect to the die opening up to or into the die opening, the mandrel arm being pushed through the extrusion block in an eccentric position, and the extrusion block being pushed through the die by the extrusion stem so that extrusion block material flows without forming a seam over the whole cross-section at uniform speed around the mandrel tip into the die opening.

17. A process for producing a rear axle support out of an extrusion block employing an extrusion press device having a container with a chamber with a longitudinal axis $M_R$ which accommodates the extrusion block, an extrusion stem which is introduced into the container chamber and features a dummy block, a mandrel body forming an inner wall of the pipe-section, and a die with an opening with a longitudinal axis $M_K$ forming an outer wall of the pipe section, the mandrel body is a mandrel arm of longitudinal axis $M_D$ with a tip, the mandrel arm being arranged eccentric in cross-section with respect to the container chamber and with respect to the die opening, the die opening being eccentric in cross-section with respect to the container chamber, and the longitudinal axis $M_D$ of the mandrel arm and the longitudinal axis $M_R$ of the container being a distance apart and substantially parallel to the longitudinal axis $M_K$ of the die opening, so that the longitudinal axis $M_K$ of the die opening in cross-section lies between a pair of straight lines $g_1$ and $g_2$ respectively passing through the mandrel arm longitudinal axis $M_D$ and the container chamber longitudinal axis $M_R$ as well as perpendicular to a line p connecting the mandrel arm longitudinal axis $M_D$ and the container chamber longitudinal axis $M_R$, the process comprising the steps of: pushing the extrusion block to the die end face by means of the extrusion stem; driving the mandrel arm from the dummy block into the extrusion block; and pushing the mandrel tip in a position eccentric with respect to the die opening up to or into the die opening, the mandrel arm being pushed through the extrusion block in an eccentric position, and the extrusion block being pushed through the die by the extrusion stem so that extrusion block material flows without forming a seam over the whole cross-section at uniform speed around the mandrel tip into the die opening.

18. A process for producing a structured hollow section out of an extrusion block employing an extrusion press device having a container with a chamber with a longitudinal axis $M_R$ which accommodates the extrusion block, an extrusion stem which is introduced into the container chamber and features a dummy block, a mandrel body forming an inner wall of the pipe-section, and a die with an opening with a longitudinal axis $M_K$ forming an outer wall of the pipe section, the mandrel body is a mandrel arm of longitudinal axis $M_D$ with a tip, the mandrel arm being arranged eccentric in cross-section with respect to the container chamber and with respect to the die opening, the die opening being eccentric in cross-section with respect to the container chamber, and the longitudinal axis $M_D$ of the mandrel arm and the longitudinal axis $M_R$ of the container being a distance apart and substantially parallel to the longitudinal axis $M_K$ of the die opening, so that the longitudinal axis $M_K$ of the die opening in cross-section lies between a pair of straight lines $g_1$ and $g_2$ respectively passing through the mandrel arm longitudinal axis $M_D$ and the container chamber longitudinal axis $M_R$ as well as perpendicular to a line p connecting the mandrel arm longitudinal axis $M_D$ and the container chamber longitudinal axis $M_R$, the process comprising the steps of: pushing the extrusion block to the die end face by means of the extrusion stem; driving the mandrel arm from the dummy block into the extrusion block; pushing the mandrel tip in a position eccentric with respect to the die opening up to or into the die opening, the mandrel arm being pushed through the extrusion block in an eccentric position, and the extrusion block being pushed through the die by the extrusion stem so that extrusion block material flows without forming a seam over the whole cross-section at uniform speed around the mandrel tip into the die opening; and shaping the hollow section using high internal pressure.

19. A process for producing a support section to accommodate directional bending forces out of an extrusion block employing an extrusion press device having a container with a chamber with a longitudinal axis $M_R$ which accommodates the extrusion block, an extrusion stem which is introduced into the container chamber and features a dummy block, a mandrel body forming an inner wall of the pipe-section, and a die with an opening with a longitudinal axis $M_K$ forming an outer wall of the pipe section, the mandrel body is a mandrel arm of longitudinal axis $M_D$ with a tip, the mandrel arm being arranged eccentric in cross-section with respect to the container chamber and with respect to the die opening, the die opening being eccentric in cross-section with respect to the container chamber, and the longitudinal axis $M_D$ of the mandrel arm and the longitudinal axis $M_R$ of the container being a distance apart and substantially parallel to the longitudinal axis $M_K$ of the die opening, so that the longitudinal axis $M_K$ of the die opening in cross-section lies between a pair of straight lines $g_1$ and $g_2$ each passing through the mandrel arm longitudinal axis $M_D$ and the container chamber longitudinal axis $M_R$ as well as perpendicular to lines p connecting the mandrel arm longitudinal axis $M_D$ and the container chamber longitudinal axis $M_R$, the process comprising the steps of: pushing the extrusion block to the die end face by means of the extrusion stem; driving the mandrel arm from the dummy block into the extrusion block; and pushing the mandrel tip in a position eccentric with respect to the die opening up to or into the die opening, the mandrel arm being pushed through the extrusion block in an eccentric position, and the extrusion block being pushed through the die by the extrusion stem so that extrusion block material flows without forming a seam over the whole cross-section at uniform speed around the mandrel tip into the die opening.

* * * * *